US005704377A

United States Patent [19]

McMullen

[11] Patent Number: 5,704,377

[45] Date of Patent: Jan. 6, 1998

[54] REMOTELLY HEATED EYELASH CURLING DEVICE ADAPTED FOR INCREASED HEAT RETENTION

[76] Inventor: Alexandra McMullen, 673 Washington Blvd., Marina Del Rey, Calif. 90292

[21] Appl. No.: 695,085

[22] Filed: Aug. 8, 1996

Related U.S. Application Data

[63] Continuation-in-part of Ser. No. 516,934, Aug. 18, 1995, Pat. No. 5,590,669.

[51] Int. Cl.[6] ..... A45D 2/48

[52] U.S. Cl. ..... 132/217; 132/216; 219/222

[58] Field of Search ..... 132/216, 217, 132/218, 317; 219/222, 225, 223

[56] References Cited

U.S. PATENT DOCUMENTS

| | | | |
|---|---|---|---|
| 1,665,327 | 4/1928 | Rissinger | 132/217 |
| 1,925,266 | 9/1933 | Manning | 132/217 |
| 2,598,718 | 6/1952 | Palmer . | |
| 2,602,458 | 7/1952 | Tuttle et al. . | |
| 2,630,516 | 8/1953 | Rausch et al. . | |
| 3,016,059 | 8/1962 | Hutton . | |
| 3,525,347 | 8/1970 | D'Elia | 132/217 |
| 3,640,290 | 2/1972 | Theis . | |
| 3,838,699 | 10/1974 | Skandalakis . | |
| 4,212,311 | 7/1980 | del Valle . | |
| 4,305,412 | 12/1981 | Nist . | |
| 4,589,432 | 5/1986 | Honda . | |
| 4,719,931 | 1/1988 | Suzuki | 132/217 |
| 4,784,165 | 11/1988 | Stein . | |
| 4,791,944 | 12/1988 | Stein . | |
| 4,993,439 | 2/1991 | Davies . | |
| 5,091,629 | 2/1992 | McGee . | |

*Primary Examiner*—Gene Mancene
*Assistant Examiner*—Pedro Philogene
*Attorney, Agent, or Firm*—Workman, Nydegger & Seeley

[57] ABSTRACT

A system for remotely heating an eyelash curling device. The system includes a remote heating apparatus having a heated projection for contacting a flexible compression strip of the eyelash curling device and adapted to heat the compression strip while not heating the corresponding compression blade or rest of the eyelash curling device. The remote heating apparatus also includes features for attaching, securing, or otherwise engaging the eyelash curling device during the heating process. The heating apparatus may optionally include a thermostat for heating and then maintaining the compression strip of the curling device to a desired temperature or within a desired temperature range, a switching mechanism for turning the heated projection component on or off, features for actuation the heating means when the eyelash curling device is attached, and a feature for indicating to the user when the compression strip has reached the desired temperature. The eyelash curling device may be optionally adapted so that the compression strip is thermally insulated from the rest of the eyelash curling device, adapted so that the compression is maintained within the desired temperature range for a larger period of time when disengaged from the remote heating apparatus, and one or more features for activating the remote heating apparatus.

20 Claims, 6 Drawing Sheets

REMOTELLY HEATED EYELASH CURLING DEVICE ADAPTED FOR INCREASED HEAT RETENTION

This application is a continuation-in-part of application Ser. No. 08/516,934, filed Aug. 18, 1995, in the name of Alexandra McMullen for "Apparatus for Remotely Heating an Eyelash Curling Device". Now issued as U.S. Pat. No. 5,590,669.

BACKGROUND OF THE INVENTION

1. The Field of the Invention

The present invention relates to the field of eyelash curling devices and more particularly to a system comprising an eyelash curling device and a remote heating apparatus for transferring heat to an appropriate location within the eyelash curling device. The eyelash curling device is specially adapted for retaining heat within the compression strip that presses against the eyelashes.

2. The Relevant Technology

Women have long been using eyelash curlers to make their eyes look more attractive. Various eyelash curlers have been employed to effect the curling of eyelashes, such as those disclosed in the following U.S. Pat. Nos.: 3,640,290, 4,305,412, 4,784,165, 4,791,944 and 4,993,439. As seen in the representative prior patents, most eyelash curlers employ a pair of tongs which are moveable toward and away from each other. An upper tong is typically made of metal or plastic while a lower tong, also made of metal or plastic, is often covered with a softer, more flexible material, such as rubber. A pair of levers are typically used to operate the tongs to bring them together tightly during the curling operation. The hard upper tong squeezes the eyelashes against the lower rubber tong. By the application of pressure for a considerable period of time, the eyelashes are caused to curl and remain curled for a few hours.

This general method and device for curling eyelashes suffers from a number of drawbacks: 1) the curling often takes a considerable amount of time; 2) the eyelashes do not remain curled for an acceptably long duration; and 3) the significant pressure often employed to speed up the rate of curling can cause eyelashes to break or fracture.

In general, it is well known in the art of hair designing that heat can speed up the process of curling hair. It also makes the curling job easier and usually results in a longer-lasting curl. With the knowledge that heating hair in general can aid in the curling or styling process, some have attempted to overcome many of the above-mentioned problems by creating a unitary device capable of heating itself to effect curling of the eyelashes. Examples of such devices may be found in U.S. Pat. Nos. 3,525,347, 3,838,699, 4,212,311 and 4,719,931. Some have even attempted to use curling rollers adapted to curl the eyelashes, much like rollers used to curl hair: e.g., U.S. Pat. No. 4,589,432, wherein a chemical solution to permanently set the eyelashes in a curled state is used with the curler.

Although there are several heated eyelash curlers known in the prior art, they employ a self-contained heating element supplied with power from batteries, electrical cord or other means in order to internally heat the device. Because of this, each of the self-heated curling devices have required significant modification of the existing eyelash curlers, which in turn renders them both more complicated and more costly to manufacture. In addition, in order to provide heating means, the resulting self-heated eyelash curling devices are generally very bulky and complex in operation. Because curling eyelashes is a somewhat technical procedure with comfort and ease of use being very important for the user, particularly because of its close proximity to the eyes, creating a very bulky and hard to use heated curling device has not adequately solved the problem of providing heated curling means. The inability to hold a self-heated eyelash curling device steady can result in burning the adjacent tissue and even the eyes. Likewise, harsh chemical perming solutions should not be brought into close proximity to the eyes.

More recently, professional hair stylists have been known to use a blow dryer or heat lamp in order to heat conventional eyelash curling devices in order to obtain the benefits of heating the lashes and thereby achieve a more sustained curl. While this has provided a simple stop-gap measure, the down side of this procedure is that blow dryers and heat lamps do not constitute appropriate heat-transfer media in light of the indiscriminate nature of the way in which they heat. In particular, blow dryers and heat lamps are unable to confine the heat to, e.g., the flexible compression strip of the eyelash curling device. As a result, the entire eyelash curling device is typically heated, which is known to result in discomfort or even burning of the person whose eyelashes are being curled. In spite of the down side of manually heating eyelash curling devices with a blow dryer or heat lamp, the fact that this method is widely used underscores the fact that the above-referenced patents do not teach eyelash curling mechanisms that have proven adequate for common, everyday use.

In light of the foregoing, it would be a significant improvement in the art to provide apparatus for heating an eyelash curling device in a manner that is simple and safe to operate.

It would yet be an advancement in the art to provide apparatus for heating an eyelash curling device that provides the proper amount of heating of the curling device while ensuring that the heat is localized to the structure that actually curls the eyelashes.

In addition, it would be an improvement in the art to provide an apparatus for heating an eyelash curling device such that the temperature can be controlled and the danger of burning the eyelashes or surrounding tissue eliminated or greatly reduced while maintaining a sufficiently hot curling mechanism to provide ease in curling and a longer curl.

Furthermore, it would be a further improvement in the art to provide means for heating an eyelash curler which would be inexpensive to manufacture and which could be used in conjunction with eyelash curlers presently used or curlers similar to those used in the market so that a user of such device could maintain the familiarity of the device while also obtaining the benefits of a heated curling process.

It would also be a significant improvement in the art to provide an eyelash curling device which has been modified so that the compression strip is able to retain heat over a larger duration such that heat can be more effectively transferred to the eyelashes during the curling procedure.

Such apparatus for curling eyelashes are disclosed and claimed herein.

SUMMARY AND OBJECTS OF THE INVENTION

The present invention relates to a system for curling eyelashes comprising a remote heating apparatus and an eyelash curling device, such as those presently used in the art for curling eyelashes. The eyelash curling device is separate and detachable from the remote heating apparatus so that the eyelash curling device can be used in similar fashion as unheated eyelash curling devices typically used by beauty salons, make-up artists, professionals and individuals. The remote heating apparatus is equipped with connecting features that are adapted to secure an eyelash curling device onto the heating apparatus while the heating process is being performed. Once the eyelash curling device has been heated to an acceptable level, it may be removed from the remote heating apparatus at any time and used as desired to curl eyelashes.

In general, unheated eyelash curling devices known in the art typically include two tongs that are pivotally secured together by means of a pin. One of the two tongs includes a flexible compression strip, while the other includes a compression blade. The compression blade and compression strip are squeezed together by means of the two tongs in order to cause the person's eyelashes to be compressed between the compression blade and the flexible compression strip. Because the flexible compression strip is able to flex or give way somewhat as the compression blade is pressed against it, it will naturally cause the eyelashes pressed between the compression blade and the flexible compression strip to curl upwards, away from the flexible compression strip and towards the compression blade.

In the past, most eyelash curling devices have been utilized at room temperature and have provided somewhat adequate curling of the eyelashes. Nevertheless, it has been discovered that by introducing heat to the curling process, much like curling irons used to curl ordinary hair, the eyelashes can be more easily curled and will remain curled longer. However, typical heated eyelash curling devices have included self-contained heating elements, which greatly increase the size, bulkiness and weight of the eyelash curling device. Alternatively, many have used blow dryers, heat lamps or other nonspecific heat sources to heat an eyelash curling device prior to curling. One can easily appreciate how sensitive a person's eyes are and how greatly increasing the bulkiness, size and weight of an eyelash curling apparatus can adversely affect the eyelash curling process, as would the indiscriminate heating of the entire eyelash curling device, part of which often contacts the face. Using such methods often results in a hot compression blade coming dangerously close to the eyelid.

In order to solve the problem of being able to heat-curl the eyelashes while avoiding the clumsiness and decreased ease of use by providing a self-contained heating mechanism, or avoiding heating the entire eyelash curling device, the present invention utilizes the system of using a remote heating apparatus along with an eyelash curling device, such as those normally used in an unheated fashion. The remote heating apparatus is designed so that only the mechanism involved in curling the eyelashes, typically a flexible compression strip, is heated, while the rest of the eyelash curling device remains cool, particularly those areas that might come in contact with the face during the eyelash curling procedure. The remote heating apparatus may also be equipped with a thermostat and an activation switch that is triggered when engaged with the eyelash curling device.

The eyelash curling device may alternatively be modified in order to adapt it for particular use with a remote heating apparatus. For instance, the eyelash curling device may be equipped with a flange or other activation feature for activating a corresponding switch in the remote heating apparatus when the two are engaged. In addition, the eyelash curling device might optionally include an insulating strip or other means for insulating the flexible compression strip from the rest of the eyelash curling device in order to keep the compression strip hotter longer and also in order to keep the eyelash curling device cool. Finally, the compression strip may be modified by being made from a more heat-resistant material and/or it may be impregnated with a material having a high specific heat to increase the length of time the compression strip remains heated within the proper temperature range.

In light of the foregoing, it is an object of the present invention to provide an improved apparatus for heating an eyelash curling device in a manner that is simple and safe to operate.

Yet another object of the present invention is to provide an apparatus for heating an eyelash curling device that provides the proper amount of heating of the curling device while insuring that the heat is localized to the structure that actually curls the eyelashes.

In addition, another object of the present invention is to provide apparatus for heating an eyelash curling device such that the temperature can be controlled and the danger of burning the eyelashes or adjoining tissue eliminated or greatly reduced while maintaining a sufficiently hot curling mechanism to provide ease in curling and a longer curl.

It is a further object of the present invention to provide means for heating an eyelash curler which would be inexpensive to manufacture and which could be used in conjunction with eyelash curlers presently used or curlers similar to those used in the market so that the user of such device could maintain the familiarity of the device, while also obtaining the benefits of the heated curling process.

It is also an object of the present invention to provide an eyelash curling device which is modified so that the compression strip is able to retain heat over a larger duration such that the heat can be more effectively transferred to the eyelashes during the curling procedure.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to a system for curling eyelashes comprising a remote heating apparatus adapted to be used in conjunction with eyelash curling devices presently used in the market to curl eyelashes. In addition, eyelash curling devices specially adapted for use with the remote heating device may be used. The remote heating apparatus is separate and detachable from the eyelash curling device so that the eyelash curling device can be used in similar fashion as unheated eyelash curling devices typically used by beauty salons and individuals. Once the eyelash curling device has been heated to an acceptable level, it may be removed from the remote heating apparatus at any time and used as desired to curl eyelashes.

As opposed to self-heating eyelash curling devices known in the art, the present invention provides for the heating of an eyelash curling device without the attendant increased size, bulk, weight, and clumsiness of self-heating eyelash curling devices. Instead, the present invention utilizes a remote heating apparatus equipped with connecting features that are adapted to secure an eyelash curling device on to the surface of the heating device while the heating process is being performed. The apparatus also provides for localized heating of the mechanism actually used in the curling process, in contrast to indiscriminate heating by, e.g., blow dryers or heat lamps.

Figure 1:
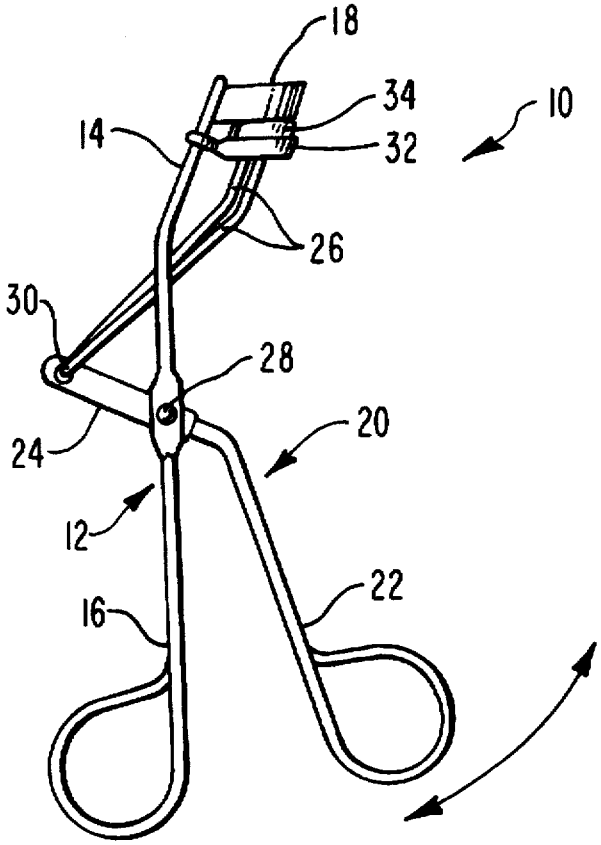
FIG. 1 (PRIOR ART)
FIG. 1 is a schematic side elevation of a conventional eyelash curling device.
Figure 2:
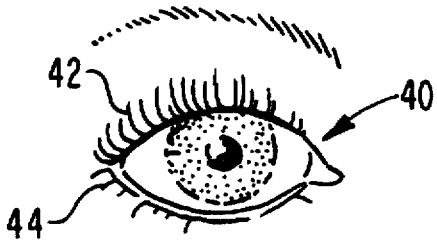
FIG. 2 (PRIOR ART)
FIG. 2 is a schematic front elevation of a human eye, depicting the upper eyelashes for curling with the curling device of FIGS. 1 and 2.

In order that the invention may better be understood, a typical eyelash curling device used to curl eyelashes is depicted in FIG. 1. FIG. 2 shows a human eye and the upper eyelashes which may be curled using the curling device of FIG. 1. More particularly, the eyelash curling device 10 depicted in FIG. 1 includes a stationary tong 12 having an upper frame 14 and a lower handle 16, both of which may be constructed of any sufficiently tough or durable material such as metal or plastic. Disposed on the upper end of the upper frame 14 is a compression blade 18 intended to compress the eyelashes against a flexible compression strip, as discussed hereinafter. Pivotally secured to the stationary tong is a moveable tong 20 that includes a lower handle 22, a pressure bar 24, and a pair of support arms 26. Any of these components may be made of any sufficiently durable material, such as metal or plastic, that is strong enough to carry out the intended function of the eyelash curling device.

The moveable tong 20 is pivotally attached to the stationary tong 12 by means of a pivot pin 28 that passes between recesses within stationary tong 12 and moveable tong 20. The pair of support arms 26 are in turn pivotally attached to the pressure bar 24 by simply being looped through a hole 30 at an end of the pressure bar 24. At the top of the pair of support arms 26 is a compression strip platform 32 into which is placed, or onto which is secured, a flexible compression strip 34. The compression strip platform is typically made of a durable material, such as metal or plastic, while the flexible compression strip is made of an elastomeric material, such as rubber, typically silicone rubber. The compression strip platform 32 is in turn slidably secured to the upper frame 14 and is disposed in engaging relationship below the compression blade 18 that is permanently secured to the upper frame 14. The flexible compression strip 34, the compression strip platform 32, and the compression blade 18 are contoured and curved in the horizontal plane to conform to the approximate spherical bulge of the human eye and eyelids. An opposing edge of the compression blade 18 and an opposing surface of the flexible compression strip 34 are essentially horizontal, parallel and symmetrical.

The eyelash curling device 10 is normally only used to apply a curl to the upper eyelashes 42 of the eye 40 shown in FIG. 2. The lower eyelashes 44 are usually not curled by the curling device since they are thin, short and naturally curled. Moreover, the force of gravity naturally causes the lower eyelashes 44 to fall down away from the eye, while causing the upper eyelashes 42 to droop.

If the flexible compression strip 34 is generally horizontal, it will curl the upper eyelashes 42 to about the same degree from one side of the eye 40 to the other. However, the eyelash curling device 10 may also be adapted with a pitched, or angled flexible compression strip 34 (not shown) in order to cause the eyelashes to curl more acutely in the area where the compression strip 34 is caused to first close against the compression blade 18 and hence, more firmly during the eyelash curling operation. In the foregoing manner eyelashes have been curled for many years. Nevertheless, it is known that heating the eyelashes during the curling operation would make the curling process easier, faster and make the eyelashes so that they remain curled longer. Heating also reduces the amount of pressure that must be applied during the curling process, which reduces the likelihood that the eyelashes will fracture or split during the curling process.

In accordance with this purpose, and as an improvement to the devices of the prior art in which the eyelash curling device was either unheated, indiscriminately heated by, e.g., a blow dryer or heat lamp, or was adapted to house a self-contained heating element, the present invention uses a far simpler system in which a remote heating apparatus is adapted to be used with any eyelash curling device known in the art or future devices that may be developed. The remote heating apparatus can also be used with eyelash curling devices that are specially adapted for use with the remote heating apparatus.

Figure 3A:
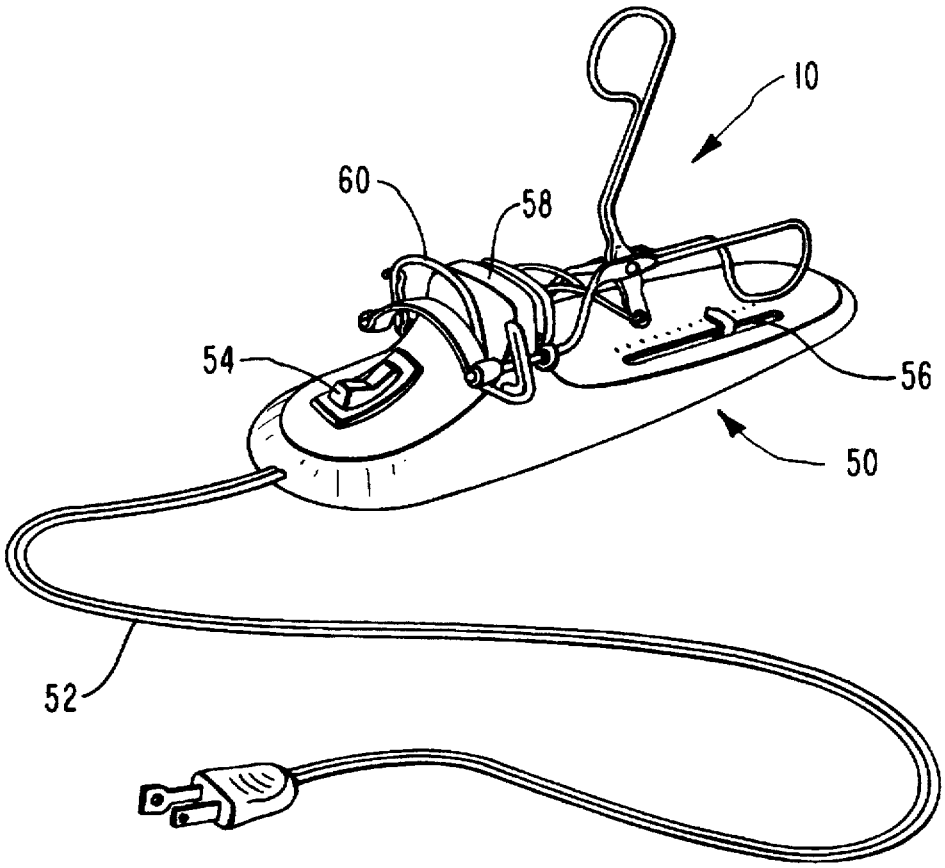
FIG. 3A is a perspective view of a remote heating apparatus adapted shown in use with the eyelash curling device of FIG. 1.
Figure 3B:
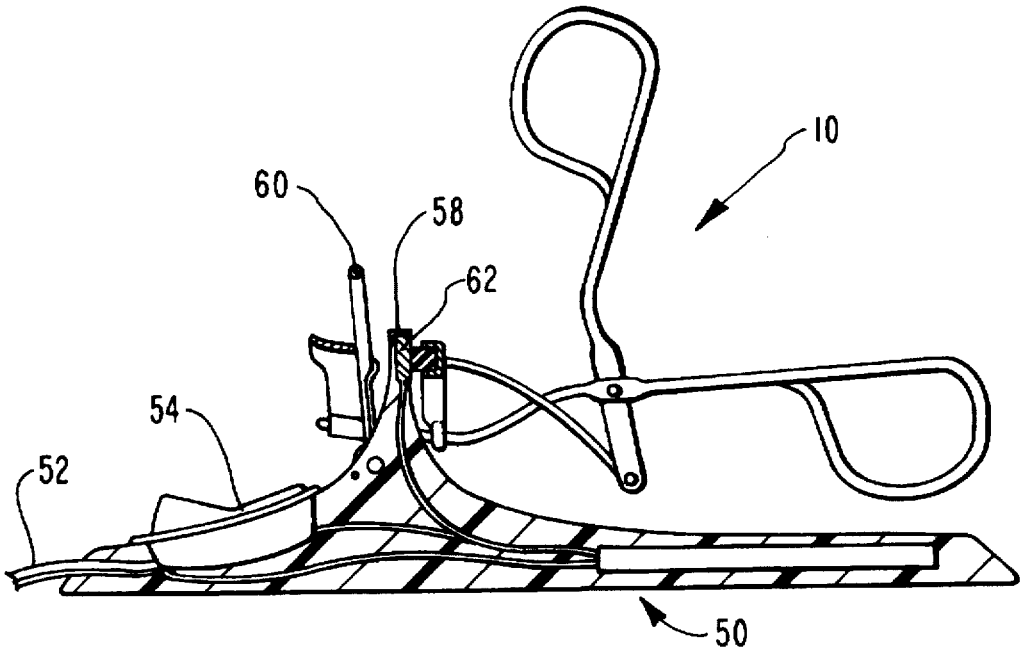
FIG. 3B is a side cross-sectional view of the heating apparatus in use with the eyelash curling device as depicted in FIG. 3A.

In a first preferred embodiment, illustrated in FIGS. 3A and 3B, a remote heating apparatus 50 is provided and shown in coupled arrangement with the eyelash curling device 10. In particular, the remote heating apparatus 50 includes a power source, such as may be provided by a power cord 52 or, alternatively, batteries (not shown). A switch 54 may be used to activate and turn off the heating apparatus 50. The heating apparatus may optionally include a thermostat 56 for regulating the temperature of the heat transfer bar 58, which heats the compression strip 34. In addition, the heating apparatus may include a timer so that it shuts off after a set duration. Heating of the heat transfer bar 58 is accomplished by means of a resistive heating element (not shown) located within or near the heat transfer bar 58. Instead of the adjustable thermostat 56, the heating apparatus may simply include a nonadjustable thermostat that regulates the temperature of the heating element, or the heating element may be such that it is only capable of heating up to a maximum temperature within the desired temperature range. The heating apparatus may optionally include a light or other indicator (not shown) to tell the user when the compression strip 34 has reached the appropriate temperature.

The heating apparatus also includes a spring biased wire base 60, which is used in conjunction with the heat transfer bar 58 to hold the eyelash curling device 10 in place while the heating process is carded out. The wire base 60 pushes against the compression blade 18 in order to urge apart the compression blade 18 and compression strip 34. The countervailing forces of the wire base 60 against the compression blade 18 and of the heating transfer bar 58 against the compression strip 34 work together as means for holding the eyelash curling device 10 in place while the heat transfer bar 58 heats the compression strip 34 to a desired temperature.

As shown more clearly in FIG. 3B, the heat transfer bar 58 may include a heat transfer strip 62 that is configured to localize the heat in the immediate area of the compression strip 34. In this way, the rest of the heat transfer bar 58 remains relatively cool compared to the heat transfer strip 62 in order to minimize the chance that the user will burn his or her hand while attaching or detaching the eyelash curling device 10. This feature may also reduce the likelihood that the heat transfer bar 58 will inadvertently heat the compression blade 18 or other part of the eyelash curling device, which preferably remains cool relative to the compression strip 34. Of course, the space that would ordinarily exist between the heat transfer bar 58 and the compression blade 18 would be expected in most cases to minimize heat transfer from the heat transfer bar 58 to the compression blade 18. Thus, it would be possible for the heat transfer bar 58 to be heated on both sides without unduly heating the compression blade 18 as long as there were adequate space between the heat transfer bar 58 and the compression blade 18.

While the embodiment shown in FIGS. 3A and 3B is illustrative of one way to accomplish the safe and reliable heating of the compression strip 34 of the eyelash curling device 10, there are a large number of design variations that will now be apparent to one of ordinary skill in the art in light of the present disclosure.

Figure 4A:
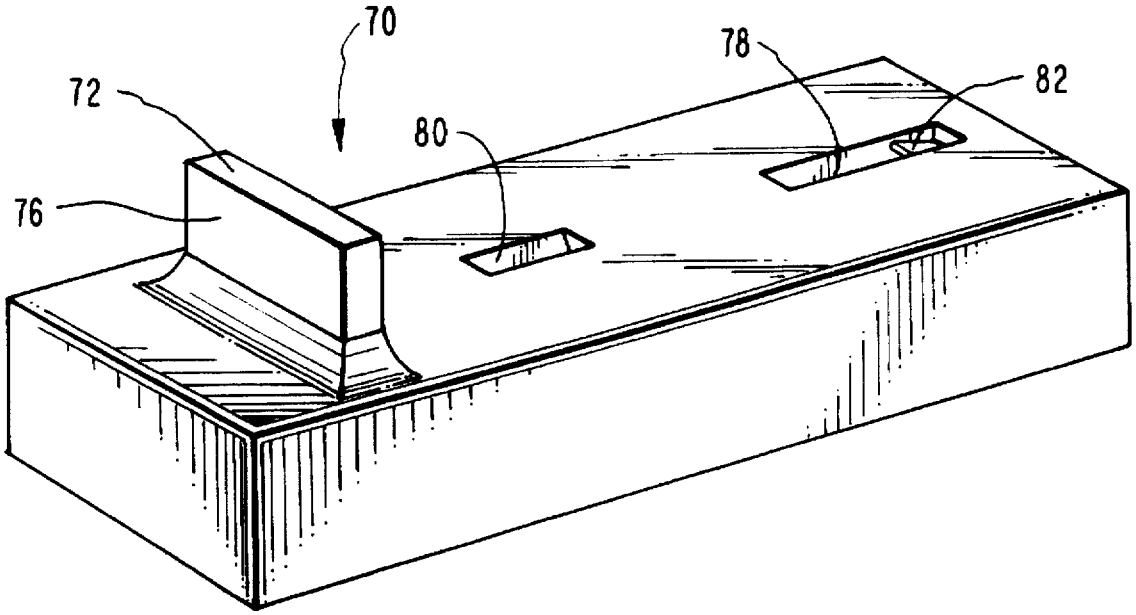
FIG. 4A is a perspective view of an alternative heating apparatus according to the invention.

For example, FIG. 4A depicts an alternative embodiment of the remote heating apparatus. In particular, alternative heating apparatus 70 includes a heated projection 72 having a heated surface 74 and an insulated surface 76. A handle channel 78 and pressure bar channel 80 are provided to assist in holding the eyelash curling device 10 in the proper position for heating the compression strip 34.

Figure 4B:
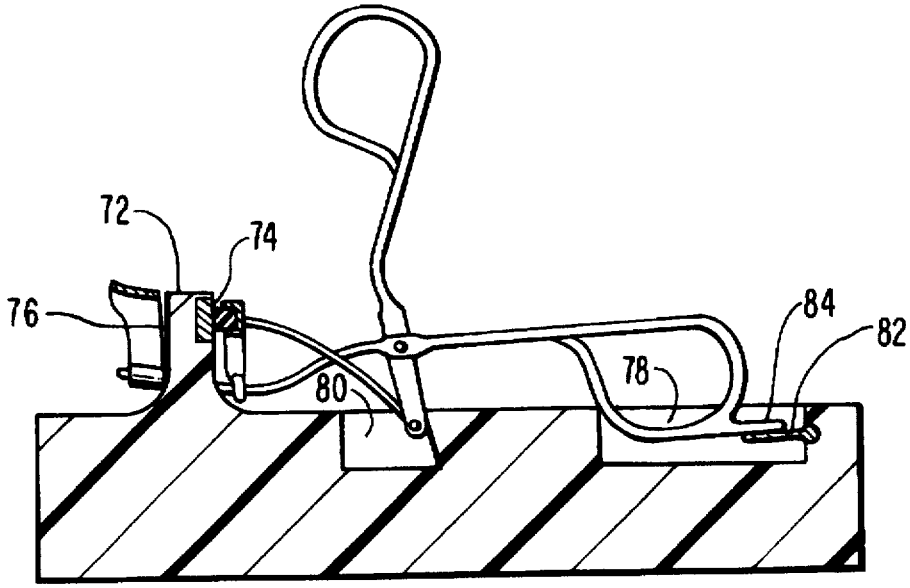
FIG. 4B is a side elevation of the heating apparatus of FIG. 5 in use with an alternative eyelash curling device adapted to activate the heating apparatus of FIG. 5A.

FIG. 4B shows the remote heating apparatus 70 of FIG. 4A in use with an eyelash curling device, wherein the lower handle 16 of the stationary tong 12 fits within the handle channel 78, while the pressure bar 24 of the moveable tong 20 fits within the pressure bar channel 80. In this fashion, the flexible compression strip 34 and compression blade 18 are spread apart to a distance sufficient to admit entrance therebetween of the heated projection 72. The heated surface 74 makes and maintains direct contact with the flexible compression strip 34, while the insulated surface 76 may or may not actually touch the compression blade 18. Because the heated projection 72 is insulated on the side adjacent the compression blade 18, the compression blade 18 is not heated even when the heated surface 74 heats the flexible compression strip 34 to the desired temperature, or within a desired temperature range. Alternatively, the heated projection 72 may be heated on both sides and still not heat the compression blade 18 so long as there is ample space therebetween.

As also depicted in FIG. 4B, the remote heating apparatus 70 may optionally include an activation switch 82 that is engaged by an activation projection 84 located in the corresponding position within the eyelash curling device 10. In one embodiment, as shown in FIG. 4B, the activation switch 82 may be disposed in an appropriate location within the handle channel 78, although it may be located anywhere so long as it can engage the activation projection 84 of the eyelash curling device 10. As also depicted by FIG. 4B, the activation projection 84 of the illustrative embodiment may be located at an end of the lower handle 16 of the stationary tong 12, although the activation projection 84 may be located anywhere within the eyelash curling device 10 so long as it is designed to engage the activation switch 82 of the heating apparatus.

Figure 5A:
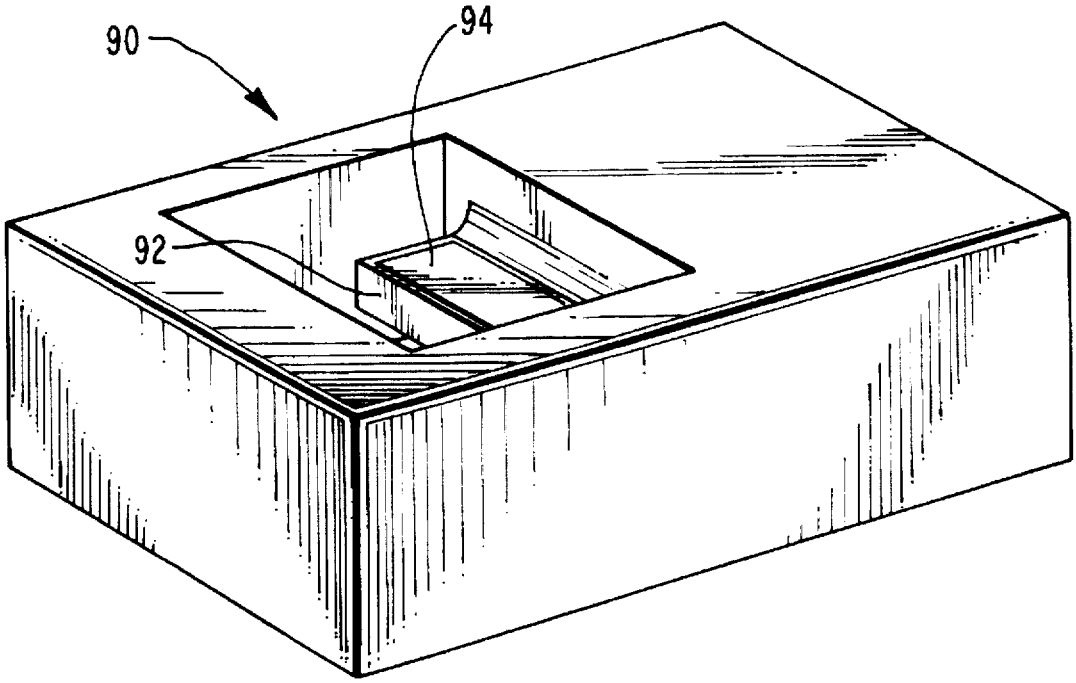
FIG. 5A is a perspective view another alternative heating apparatus according to the invention.
Figure 5B:
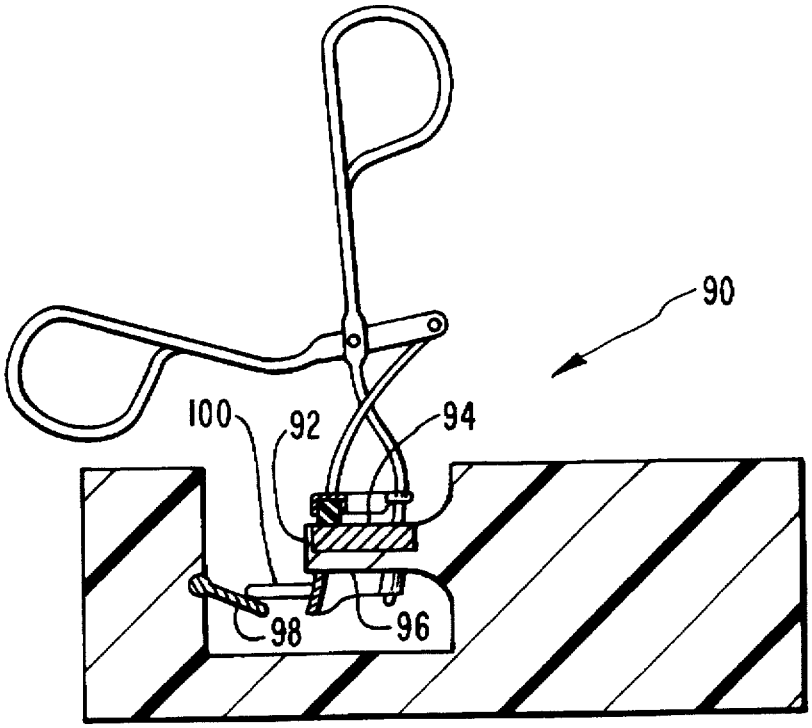
FIG. 5B is a side elevation of the heating apparatus of FIG. 5A in use with an alternative eyelash curling device adapted to activate the heating apparatus of FIG. 5A.

FIGS. 5A and 5B show another alternative embodiment of the remote heating apparatus in which the remote heating apparatus 90 is designed to engage the eyelash curling device 10 in a manner such that the eyelash curling device 10 projects vertically from the remote heating device 90 while in use. Like the alternative heating apparatus 70 shown in FIGS. 4A and 4B, the remote heating apparatus 90 of FIGS. 5A and 5B includes a heated projection 92, which includes a heated surface 94 and an insulated surface 96. The width of the heated projection 92 corresponds approximately to the widest opening of the compression blade 18 and compression strip 34 in order to provide a tight enough fit when the eyelash curling device 10 is engaged with the heating apparatus 90 so that it will remain in place as a result of the pressure of the compression blade 18 and compression strip 34 on the heated projection 92. The remote heating apparatus 90 of FIGS. 5A and 5B may optionally include an activation switch 98 disposed near the heated projection 92 in order to engage an activation projection 100 located within eyelash curling device 10. In the example shown in FIGS. 5A and 5B, the activation switch 98 is located within a recess within which the heated projection 92 is disposed, while the activation projection 100 is laterally displaced from the compression blade 18 in a direction away from the eye when the eyelash curling device 10 is in use.

Figure 6A:
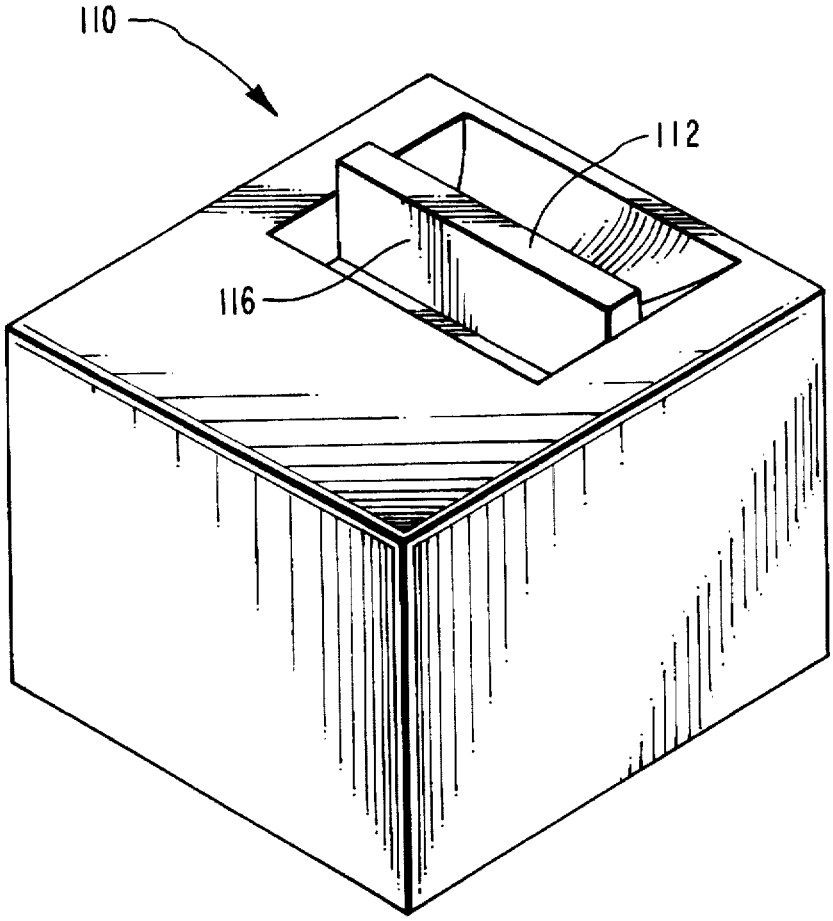
FIG. 6A is a perspective view another alternative heating apparatus according to the invention
Figure 6B:
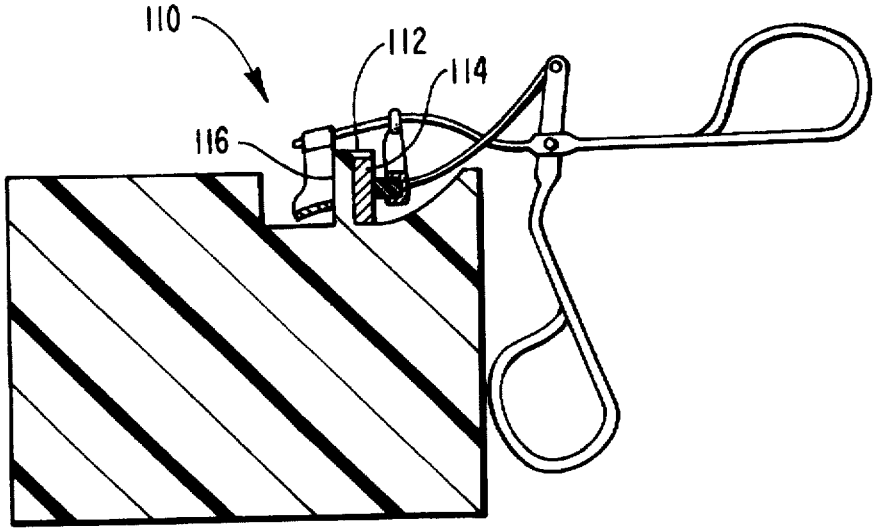
FIG. 6B is a side elevation of the heating apparatus of FIG. 6A in use with the eyelash curling device of FIG. 1.

In yet another alternative embodiment of the heating apparatus, FIGS. 6A and 6B depict a remote heating apparatus 110 having a heated projection 92 configured such that the eyelash curling device 10 is in an approximate horizontal configuration when attached to the remote heating apparatus 110. This embodiment differs from the embodiment shown in FIGS. 4A and 4B in that there are no channels for accepting the pressure bar, lower handle, or any other structure of the eyelash curling device save the compression blade 18, compression strip 34 and adjacent structures. As in other embodiments, the heated projection 112 includes a heated surface 114 and an insulated surface 116.

Within any of the foregoing remote heating apparatus is a heating element (not shown), such as a resistive heating element powered by electricity. The remote heating apparatus includes means (not shown) for transferring the heat generated by said resistive heating element to the heated projection, particularly the heated surface. Optionally included within the remote heating apparatus is a thermostat (not shown) for maintaining the temperature of the heated surface to within an appropriate temperature range in order to heat the flexible compression strip to the desired temperature or temperature range.

The flexible compression strip may be heated to a wide range of temperatures because it has been found that any temperature above about 80° F. will have a positive effect on the curling process, i.e., will increase the ease and speed of curling and/or maintain the curl longer. On the other hand, hair doesn't actually burn or become severely damaged until it is heated to about 400° F. Therefore, the flexible compression strip may conceivably be heated to any temperature within the broad range of about 80° F. to about 400° F. so long as the temperature does not harm or destroy the flexible compression strip, cause the flexible compression strip to melt or otherwise become transferred to the eyelashes, or cause burning of the eyes and adjacent tissues due to radiant heat from the flexible compression strip. In general, temperatures ranging from about 90° F. to about 250° F. are preferred, with about 100° F. to about 150° F. being more preferred, and about 100° F. to about 125° F. being most preferred.

The remote heating apparatus may optionally include a temperature gauge or temperature light in order to alert the user that the flexible compression strip of the eyelash curling device has been heated to an acceptable temperature or within an appropriate temperature range. In addition, the remote heating apparatus can be optionally adapted to include an on/off switch that can be manually actuated (FIGS. 3A and 3B), or automatically actuated upon inserting or placing the eyelash curling device onto the remote heating apparatus (FIGS. 4A–5B). As also shown above, it may be advantageous to adapt the eyelash curling device with a projection or flange that activates a corresponding switch within the remote heating apparatus for turning on the heating mechanism. Upon removal of the eyelash curling device and therefore the projection, the remote heating apparatus will be caused to be turned off. If the remote heating apparatus is activated in this manner it will generally not work with conventional eyelash curling devices.

With respect to the eyelash curling device, any of the remote heating apparatus depicted above may be used with any conventional eyelash curling device known in the art. Nevertheless, it is certainly within the scope of the present invention to modify the eyelash curling device in order for it to be better suited or compatible with the remote heating apparatus. For example, the flexible compression strip may preferably be made of an elastomeric material that is able to withstand wide fluctuations of temperature without experiencing thermal breakdown. In general, a wide variety of silicone rubbers exist that can withstand temperatures within the preferred ranges, although specially adapted materials might be substituted for ordinary silicone rubber for any reason, such as where high operating temperatures are used.

In addition, the flexible compression strip may be impregnated with a material having a high specific heat in order to increase the time in which the compression strip is maintained at the desired temperature or within the desired temperature range after decoupling the eyelash curling device from the remote heating apparatus. Such materials include metal, ceramics, metal oxides, and other dense materials. The materials having a high specific heat may be included as small particles or fibers or as a bar inserted within the flexible compression strip at a distance below the surface that still maintains the flexibility of the compression strip. This embodiment would also be expected to speed up the time it takes to heat up the compression strip.

In a preferred embodiment, the soft flexible material within the compression strip comprises dimethyl silicone rubber impregnated with a heat retention filler. A preferred heat retention filler having a high specific heat comprises precipitated micro alumina hydrate. Other materials include finely divided alumina, microsilica, finely divided silica, or mixtures of the foregoing. Nevertheless, any metallic oxide or ceramic having an appropriate heat capacity and compatibility with rubbers used in the compression strip may be used. The compression strip material may also include color pigments and other components to give it the desired properties. In a preferred embodiment, the dimethyl silicone rubber is cured with an organic peroxide.

Figure 7:
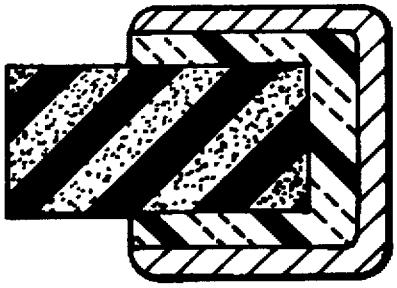
FIG. 7 is side cross-sectional view of a compression strip of an alternative eyelash curling device that is insulated from the rest of the eyelash curling device.

The compression strip may also be better maintained within the desired operating temperature if insulated from the rest of the eyelash curling device in order to impede the flow of heat. This may be accomplished, for example, by placing a highly insulating material between the compression strip and the compression strip platform to which it is attached, as depicted in FIG. 7. Alternatively, the compression strip platform may, either in whole or in part, comprise a highly insulating material that would serve to impede the flow of heat from the flexible compression strip to the rest of the eyelash curling device, such as the moveable tongs or handles. This alteration would also have the beneficial effect of keeping the rest of the eyelash curling device cool relative to the heated compression strip. Finally, the compression blade may be made of an insulating material and/or a material having a relatively low specific heat so that it will remain relatively cool even after being pressed against the heated compression strip.

In another embodiment it may be preferable for the compression blade 18 to be made of a material having a low thermal conductivity so that heat will be more slowly dissipated from the compression strip upon engaging the compression blade and compression strip during the eyelash curling procedure. In general, the compression blade will comprise a metal for strength and ease of formation.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An eyelash curling device for curling eyelashes adapted for use with a remote heating apparatus such that the eyelash curling device is detached from the remote heating apparatus when used to curl the eyelashes, the eyelash curling device comprising:

a compression strip including a flexible material impregnated with a material having a high specific heat for increasing the time in which the compression strip is maintained within a desired temperature range after the eyelash curling device is detached from the remote heating apparatus;

a compression blade; and means for selectively engaging and disengaging the compression blade and the compression strip.

2. An eyelash curling device as defined in claim 1, further including means for thermally insulating the compression strip when heated in order to impede the flow of heat from the compression strip to any other region of the eyelash curling device.

3. An eyelash curling device as defined in claim 1, wherein the compression strip comprises a material that is adapted to resist thermal breakdown such that can be heated to temperatures up to about 400° F. without significant breakdown of the material.

4. An eyelash curling device as defined in claim 1, wherein the compression strip comprises a material that is adapted to resist thermal breakdown such that can be heated to temperatures up to about 250° F. without significant breakdown of the material.

5. An eyelash curling device as defined in claim 1, wherein the flexible material of the compression strip comprises silicone rubber.

6. An eyelash curling device as defined in claim 1, wherein the flexible material of the compression strip comprises dimethyl silicone rubber cured with an organic peroxide.

7. An eyelash curling device as defined in claim 1, wherein the flexible material of the compression strip further includes a color pigment.

8. An eyelash curling device as defined in claim 1, wherein the material having a high specific heat comprises a metal oxide.

9. An eyelash curling device as defined in claim 1, wherein the material having a high specific heat comprises micro alumina hydrate.

10. An eyelash curling device as defined in claim 1, wherein the material having a high specific heat comprises finely divided silica.

11. An eyelash curling device as defined in claim 1, wherein the material having a high specific heat comprises ceramic particles.

12. An eyelash curling device as defined in claim 1, wherein the material having a high specific heat comprises a solid ceramic material.

13. An eyelash curling device for curling eyelashes adapted use with a remote heating apparatus such that the eyelash curling device is detached from the remote heating apparatus when used to curl the eyelashes, the eyelash curling device comprising:

a compression strip including a flexible silicone-based material impregnated with micro alumina hydrate particles;

a compression blade; and means for selectively engaging and disengaging the compression blade and the compression strip.

14. An eyelash curling device as defined in claim 13, wherein the flexible silicone-based materials is further impregnated with silica particles.

15. An eyelash curling device as defined in claim 13, wherein the flexible silicone-based material comprises dimethyl silicone rubber cured with an organic peroxide.

16. An eyelash curling device as defined in claim 13, wherein the compression blade comprises a material having a low thermal conductivity.

17. An eyelash curling device as defined in claim 13, wherein the compression strip is substantially thermally insulated from other parts of the eyelash curling device.

18. An eyelash curling device for curling eyelashes adapted for use with a remote heating apparatus such that the eyelash curling device is detached from the remote heating apparatus when used to curl the eyelashes, the eyelash curling device comprising;

a compression strip including a dimethyl silicone rubber cured with organic peroxide and impregnated with a material having a high specific heat and a color pigment;

a compression blade; and means for selectively engaging and disengaging the compression blade and the compression strip.

19. An eyelash curling device as defined in claim 18, wherein the material having a high specific heat comprises micro alumina hydrate.

20. An eyelash curling device as defined in claim 18, wherein the material having a high specific heat is selected from the group consisting of ceramics, metal oxides, alumina, silica, and mixtures of the foregoing.

* * * * *

UNITED STATES PATENT AND TRADEMARK OFFICE

CERTIFICATE OF CORRECTION

PATENT NO. : 5,704,377

DATED : January 6, 1998

INVENTOR(S) : Alexandra McMullen

It is certified that error appears in the above-identified patent and that said Letters Patent is hereby corrected as shown below:

On the title page and column 1, line 1, Title, change "REMOTELLY" to --REMOTELY--

Col. 5, line 7, after "invention" insert a period

Col. 7, line 8, after "process is" change "carded" to --carried--

Col. 8, line 43, after "projection" change "92" to --112--

Col. 12, line 5, after "silicone-based" change "materials" to --material--

Signed and Sealed this

Eighth Day of September, 1998

*Attest:*

Bruce Lehman

BRUCE LEHMAN

*Attesting Officer*

*Commissioner of Patents and Trademarks*